US009593442B2

(12) United States Patent
Bellinger et al.

(10) Patent No.: US 9,593,442 B2
(45) Date of Patent: Mar. 14, 2017

(54) METHOD TO CONTROL A DRYING CYCLE OF A LAUNDRY TREATING APPLIANCE

(71) Applicant: WHIRLPOOL CORPORATION, Benton Harbor, MI (US)

(72) Inventors: Ryan R. Bellinger, Saint Joseph, MI (US); David J. Kmet, Paw Paw, MI (US); Peter J. Richmond, Berrien Springs, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 28 days.

(21) Appl. No.: 14/735,182

(22) Filed: Jun. 10, 2015

(65) Prior Publication Data

US 2015/0284898 A1 Oct. 8, 2015

Related U.S. Application Data

(62) Division of application No. 13/267,312, filed on Oct. 6, 2011, now Pat. No. 9,080,283.

(51) Int. Cl.

| | |
|---|---|
| ***F26B 3/00*** | (2006.01) |
| ***D06F 58/28*** | (2006.01) |
| ***D06F 58/26*** | (2006.01) |

(52) U.S. Cl.

CPC ..... *D06F 58/28* (2013.01); *D06F 58/26* (2013.01); *D06F 2058/2829* (2013.01); *D06F 2058/2851* (2013.01); *D06F 2058/2864* (2013.01); *D06F 2058/2893* (2013.01); *D06F 2058/2896* (2013.01)

(58) Field of Classification Search

CPC ..... D06F 58/28; D06F 2058/2829; D06F 2058/2893; D06F 2058/2864; D06F 2058/2851; D06F 58/26; D06F 2058/2896; D06F 58/263

USPC ..... 34/495, 493, 476, 486, 445, 527, 543, 34/526; 219/492

See application file for complete search history.

(56) References Cited

U.S. PATENT DOCUMENTS

| | | | | | |
|---|---|---|---|---|---|
| 3,028,680 | A * | 4/1962 | Conlee | D06F 58/28 | 34/145 |
| 3,122,358 | A * | 2/1964 | Cobb | D06F 58/28 | 34/527 |
| 3,213,548 | A * | 10/1965 | Deaton | D06F 58/28 | 34/527 |
| 3,217,422 | A * | 11/1965 | Fuqua | D06F 58/28 | 34/527 |
| 3,254,423 | A * | 6/1966 | Ruelle | G05D 23/1919 | 34/534 |
| 3,510,957 | A * | 5/1970 | Jarvis | D06F 58/28 | 34/563 |
| 3,621,202 | A * | 11/1971 | Gemert | D06F 58/28 | 219/400 |
| 3,942,265 | A * | 3/1976 | Sisler | D06F 58/28 | 34/527 |
| 4,019,259 | A * | 4/1977 | Veraart | D06F 58/28 | 34/550 |
| 4,412,389 | A * | 11/1983 | Kruger | D06F 58/28 | 34/535 |
| 4,586,267 | A * | 5/1986 | Sussman | D06F 58/28 | 34/490 |

(Continued)

*Primary Examiner* — Kenneth Rinehart
*Assistant Examiner* — Bao D Nguyen

(57) ABSTRACT

An apparatus and method for controlling a drying cycle of a laundry treating appliance by monitoring a temperature of the exhaust air flow.

8 Claims, 5 Drawing Sheets

(56) References Cited

U.S. PATENT DOCUMENTS

| | | | | | |
|---|---|---|---|---|---|
| 4,622,759 | A * | 11/1986 | Abe | D06F 58/28 | 34/546 |
| 4,763,425 | A * | 8/1988 | Grennan | D06F 58/28 | 34/552 |
| 4,827,627 | A * | 5/1989 | Cardoso | D06F 58/263 | 34/526 |
| 5,560,124 | A * | 10/1996 | Hart | D06F 58/28 | 34/493 |
| 5,682,684 | A * | 11/1997 | Wentzlaff | D06F 58/28 | 34/495 |
| 6,079,121 | A * | 6/2000 | Khadkikar | D06F 58/28 | 236/47 |
| 6,199,300 | B1 * | 3/2001 | Heater | D06F 58/28 | 34/446 |
| 6,775,923 | B2 * | 8/2004 | Do | D06F 58/28 | 34/524 |
| 7,594,343 | B2 * | 9/2009 | Woerdehoff | D06F 58/28 | 219/497 |
| 2006/0101587 | A1 * | 5/2006 | Hong | D06F 58/28 | 8/149.1 |
| 2006/0137105 | A1 * | 6/2006 | Hong | D06F 25/00 | 8/147 |
| 2008/0313922 | A1 * | 12/2008 | Bae | D06F 58/203 | 34/491 |
| 2012/0096737 | A1 * | 4/2012 | Kmet | D06F 58/28 | 34/443 |

* cited by examiner

METHOD TO CONTROL A DRYING CYCLE OF A LAUNDRY TREATING APPLIANCE

CROSS REFERENCE TO RELATED APPLICATIONS

This application is a divisional of and claims the benefit of U.S. patent application Ser. No. 13/267,312, filed on Oct. 6, 2011, which is hereby incorporated by reference.

BACKGROUND OF THE INVENTION

Laundry treating appliances, such as laundry dryers, may be provided with a treating chamber in which laundry items are placed for treatment according to a cycle of operation. For some laundry treating appliances, the laundry items may be treated by air flow to remove liquid from the laundry items.

SUMMARY OF THE INVENTION

A method of drying laundry by operating a laundry dryer having a treating chamber for receiving laundry for drying comprises supplying air to the treating chamber to define a supply air flow; exhausting the supply air from the treating chamber to define an exhaust air flow; repeatedly determining over time the temperature of the exhaust air flow to define an exhaust temperature signal; heating the supply air flow by repeatedly cycling a heater for the supply air flow between an ON state, which starts when the exhaust temperature signal satisfies a low temperature set point, and an OFF state, which starts when the exhaust temperature signal satisfies a high temperature set point; determining from the temperature signal a heat time and a trip time, a cool time and a reset time, an extremum time, or an overshoot area to determine a ratio between the heat time and the trip time, a ratio between the cool time and the reset time; and initiating the termination of the drying of the laundry when one of the ratio between the heat time and the trip time, a ratio between the cool time and the reset time, the extremum time and the overshoot area indicates the laundry is dried.

DESCRIPTION OF EMBODIMENTS OF THE INVENTION

Figure 1:
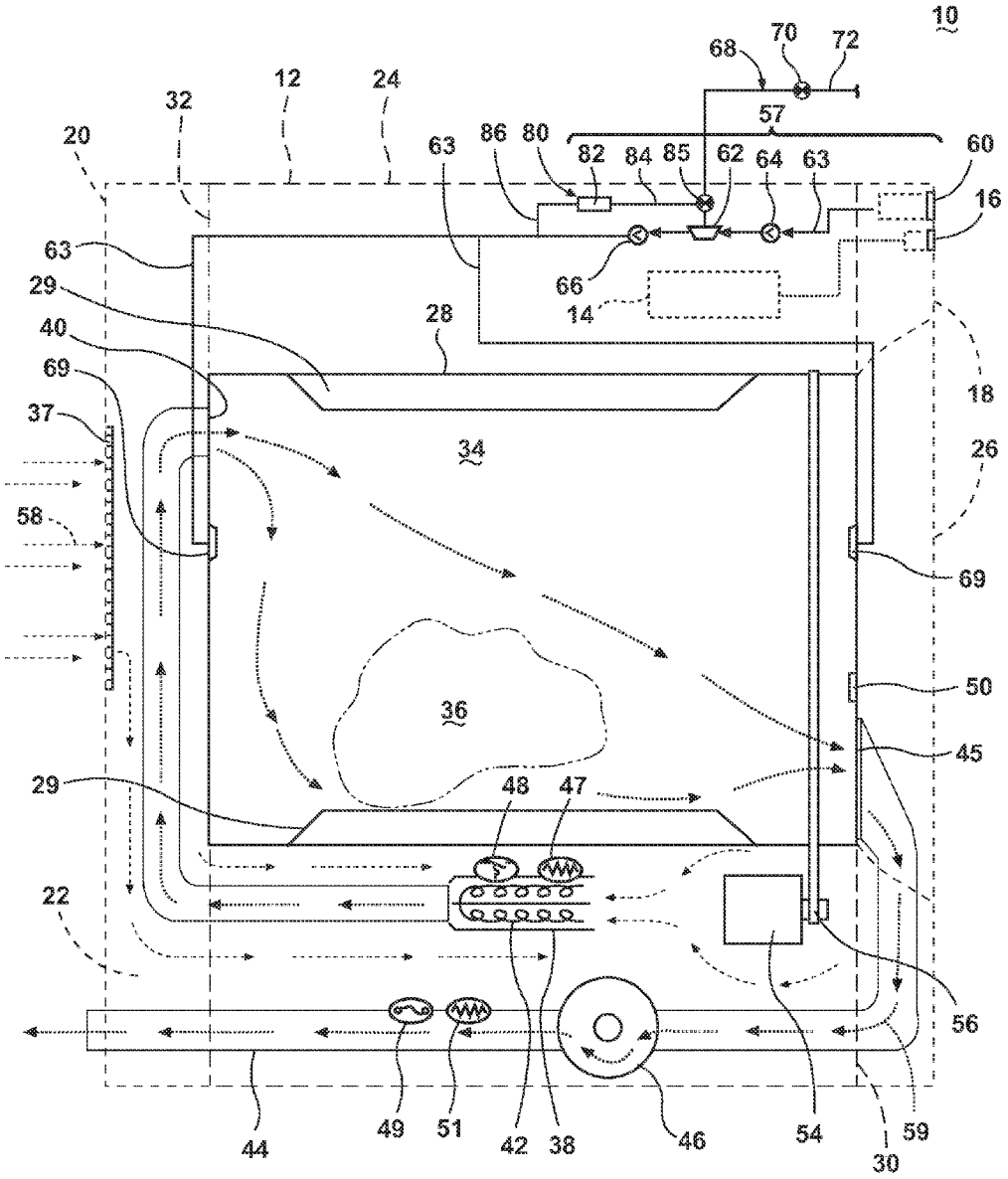
FIG. 1 is a schematic view of a laundry treating appliance in the form of a clothes dryer according to a first embodiment of the invention.

FIG. 1 is a schematic view of a laundry treating appliance 10 in the form of a clothes dryer 10 that may be controlled according to one embodiment of the invention. The clothes dryer 10 described herein shares many features of a traditional automatic clothes dryer, which will not be described in detail except as necessary for a complete understanding of the invention. While the embodiments of the invention are described in the context of a clothes dryer 10, the embodiments of the invention may be used with any type of laundry treating appliance, non-limiting examples of which include a washing machine, a combination washing machine and dryer and a refreshing/revitalizing machine.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary front and rear bulkheads 30, 32, which, along with the door 26, collectively define a treating chamber 34 for treating laundry. As illustrated, and as is the case with most clothes dryers, the treating chamber 34 is not fluidly coupled to a drain. Thus, any liquid introduced into the treating chamber 34 may not be removed merely by draining. It is noted that the liquid may include at least one of water and treating chemistry.

Non-limiting examples of laundry that may be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be treated in the clothes dryer 10.

The drum 28 may include at least one lifter 29. In most dryers, there may be multiple lifters. The lifters may be located along an inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a cycle of operation. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form, in part, a supply conduit 38, which has one end open to ambient air via a rear vent 37 and another end fluidly coupled to an inlet grill 40, which may be in fluid communication with the treating chamber 34.

The air system may further include an air exhaust portion that may be formed in part by an exhaust conduit 44. A lint trap 45 may be provided as the inlet from the treating chamber 34 to the exhaust conduit 44. A blower 46 may be fluidly coupled to the exhaust conduit 44. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct (not shown) for exhausting the air from the treating chamber 34 to the outside of the clothes dryer 10.

A heating system may be provided to heat the air supplied by the heating system. The heating system may include a heating element 42 lying within the supply conduit 38 and may be operably coupled to and controlled by the controller 14. If the heating element 42 is turned on, the supplied air will be heated prior to entering the drum 28.

The air heating system may further include various sensors and other components, such as a thermistor 47 and a thermostat 48, which may be coupled to the supply conduit 38 in which the heater 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining an inlet temperature. A thermistor 51 and a thermal fuse 49 may be coupled to the exhaust conduit 44, with the thermistor 51 being used to determine an exhaust air flow temperature that exits the exhaust conduit 44 outside the clothes dryer 10. The thermistor 51 may be a negative temperature coefficient (NTC) thermistor while a positive temperature coefficient (PTC) thermistor may be also possible.

A moisture sensor 50 may be positioned in the interior of the treating chamber 34 to monitor the amount of moisture of the laundry in the treating chamber 34. One example of a moisture sensor 50 is a conductivity strip. The moisture sensor 50 may be operably coupled to the controller 14 such that the controller 14 receives output from the moisture sensor 50. The moisture sensor 50 may be mounted at any location in the interior of the dispensing dryer 10 such that the moisture sensor 50 may be able to accurately sense the moisture content of the laundry. For example, the moisture sensor 50 may be coupled to one of the bulkheads 30, 32 of the drying chamber 34 by any suitable means.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible. The number, type and placement of the nozzles 69 are not germane to the invention.

As illustrated, the dispensing system 57 may include a reservoir 60, which may be a cartridge, for a treating chemistry that is releasably coupled to the dispensing system 57, which dispenses the treating chemistry from the reservoir 60 to the treating chamber 34. The reservoir 60 may include one or more cartridges configured to store one or more treating chemistries in the interior of cartridges.

A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation. The water supply 68 may be fluidly coupled to the mixing chamber 62 to provide water from the water source to the mixing chamber 62. The water supply 68 may include an inlet valve 70 and a water supply conduit 72. It is noted that, instead of water, a different treating chemistry may be provided from the exterior of the clothes dryer 10 to the mixing chamber 62.

The treating chemistry may be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 may also be provided with a steam generating system 80 which may be separate from the dispensing system 57 or integrated with portions of the dispensing system 57 for dispensing steam and/or liquid to the treating chamber 34 according to a cycle of operation. The steam generating system 80 may include a steam generator 82 fluidly coupled with the water supply 68 through a steam inlet conduit 84. A fluid control valve 85 may be used to control the flow of water from the water supply conduit 72 between the steam generating system 80 and the dispensing system 57. The steam generator 82 may further be fluidly coupled with the one or more supply conduits 63 through a steam supply conduit 86 to deliver steam to the treating chamber 34 through the nozzles 69. Alternatively, the steam generator 82 may be coupled with the treating chamber 34 through one or more conduits and nozzles independently of the dispensing system 57.

The steam generator 82 may be any type of device that converts the supplied liquid to steam. For example, the steam generator 82 may be a tank-type steam generator that stores a volume of liquid and heats the volume of liquid to convert the liquid to steam. Alternatively, the steam generator 82 may be an in-line steam generator that converts the liquid to steam as the liquid flows through the steam generator 82.

It will be understood that the details of the dispensing system 57 and steam generating system 80 are not germane to the embodiments of the invention and that any suitable dispensing system and/or steam generating system may be used with the dryer 10. It is also within the scope of the invention for the dryer 10 to not include a dispensing system 57 or a steam generating system 80.

Figure 2:
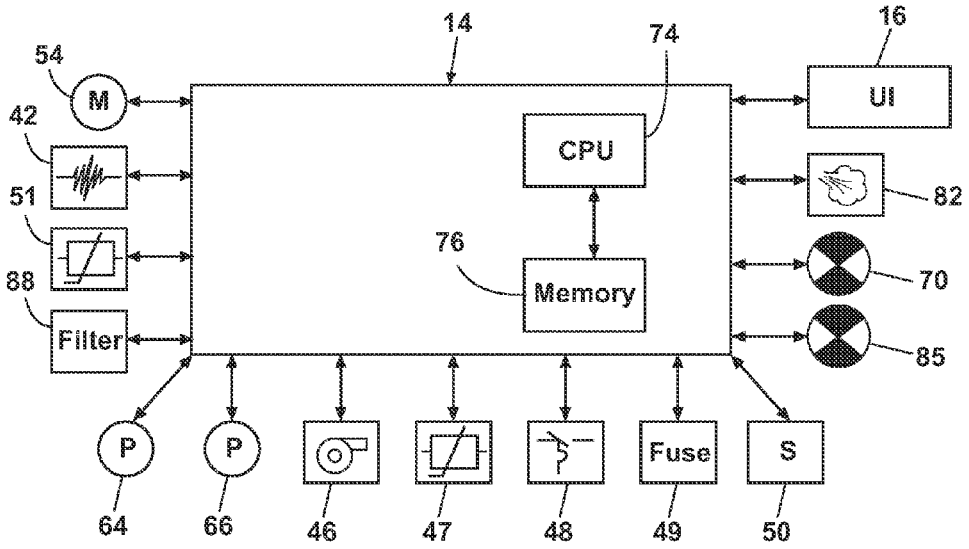
FIG. 2 is a schematic view of a controller of the clothes dryer in FIG. 1.

FIG. 2 is a schematic view of the controller 14 coupled to the various components of the dryer 10. The controller 14 may be communicably coupled to components of the clothes dryer 10 such as the heater 42, blower 46, thermistor 47, thermostat 48, thermal fuse 49, thermistor 51, moisture sensor 50, motor 54, inlet valve 70, pumps 64, 66, steam generator 82, signal filter 88, and fluid control valve 85 to either control these components and/or receive their input for use in controlling the components. It may be understood that the thermistor 51 may include the signal filter 88 while the thermistor 51 and the signal filter 88 may be physically separate to each other. The controller 14 is also operably coupled to the user interface 16 to receive input from the user through the user interface 16 for the implementation of the drying cycle and provide the user with information regarding the drying cycle.

The user interface 16 may be provided having operational controls such as dials, lights, knobs, levers, buttons, switches, and displays enabling the user to input commands to a controller 14 and receive information about a treatment cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may implement a treatment cycle selected by the user according to any options selected by the user and provide related information to the user. The controller 14 may also comprise a central processing unit (CPU) 74 and an associated memory 76 where various treatment cycles and associated data, such as look-up tables, may be stored. One or more software applications, such as an arrangement of executable commands/instructions may be stored in the memory and executed by the CPU 74 to implement one or more treatment cycles.

In general, the controller 14 will effect a cycle of operation to effect a treating of the laundry in the treating chamber 34, which may or may not include drying. The controller 14 may actuate the blower 46 to draw a supply air flow 58 into the supply conduit 38 through the rear vent 37 when air flow is needed for a selected treating cycle. The controller 14 may activate the heater 42 to heat the supply air flow 58 as it passes over the heater 42, with the heated air flow 59 being supplied to the treating chamber 34. The heated air flow 59 may be in contact with a laundry load 36 as it passes through the treating chamber 34 on its way to the exhaust conduit 44 to effect a moisture removal of the laundry. The heated air flow 59, in the form of an exhaust air flow, may exit the treating chamber 34, and flow through the blower 46 and the exhaust conduit 44 to the outside of the clothes dryer 10.

The controller 14 may activate the thermistor 51 to measure the temperature of the heated air flow 59 in the form of the exhaust air flow. The temperature signal of the exhaust air flow 59 may be measured by the thermistor 51 with a predetermined measurement frequency, and transmitted to the controller 14 to execute one or more software applications to implement one or more cycles of operation. The signal filter 88 may selectively filter at least a portion of the temperature signal to selectively remove unwanted frequency components or enhance wanted frequency components prior to transmitting the filtered signal to the controller 14. Alternatively, at least a portion of the temperature signal may be selectively filtered by one or more software applications stored in the memory 76 of the controller 14.

The controller 14 continues the cycle of operation until completed. If the cycle of operation includes drying, the controller 14 determines when the laundry is dry. The determination of a "dry" load has historically been based on the moisture content of the laundry, which is typically set by the user based on the selected cycle, an option to the selected cycle, or a user-defined preference. The moisture content has historically been determined using a moisture sensor, such as a conductivity sensor, which can be used to calculate a projected drying time. The conductivity sensors cannot be used for an absolute determination of dryness because they are not accurate below approximately 10% moisture content and a load is typically not considered dry unless it has less than 5% moisture content. Thus, the output of the conductivity sensor is used to calculate a drying time that it is expected to have less than 5% moisture content. As overly dry laundry is typically better received by the consumer than under-dried laundry, the drying time calculated from the conductivity sensor tends to be on the side of over drying. That said, most consumers do not like completely dry laundry having a 0% moisture content.

For a drying cycle, the accurate determination of when a load is dry is beneficial in that it avoids the waste of energy associated with over drying and it provides the consumer with the expected degree of drying.

The invention addresses the problems associated with erroneously determining the completion of a drying cycle by establishing algorithms to determine the completion of a drying cycle from the exhaust temperature profile for the exhaust air flow.

Figure 3:
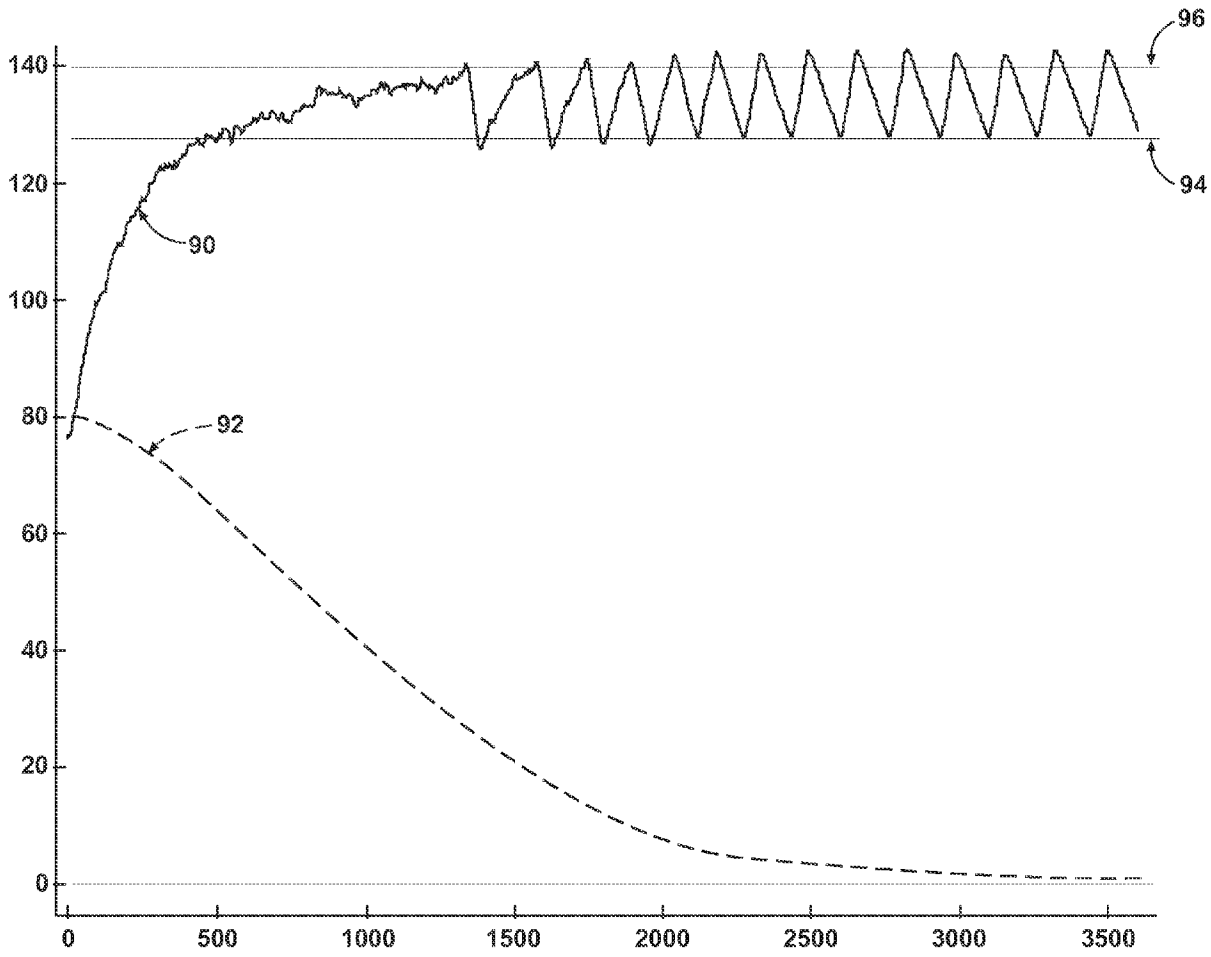
FIG. 3 is a plot of an exhaust temperature and moisture content of an exhaust air flow with respect to the time during a drying cycle according to the first embodiment of the invention.

FIG. 3 is a plot of an exhaust temperature 90 and corresponding moisture content 92 of an exhaust air flow 59 with respect to time during a cycle of drying. To effect a heating of the air to dry the laundry, the heater 42 is cycled ON and OFF in response to the exhaust air temperature satisfying a low temperature set point 94 and a high temperature set point 96, respectively. As illustrated, the exhaust temperature 90 of the exhaust air flow 59 may steeply increase in the initial stage of drying while the heater 42 is turned ON to evaporate liquid from the laundry 36, which is attributable to the initial warming of the drum 28, the cabinet 12, and the laundry 36 followed by the evaporation of the moisture on the surface of the fabric. After the initially steep increase, the exhaust temperature 90 may increase slowly as the liquid in the laundry 36 is driven toward the exterior of the laundry 36, until the exhaust temperature satisfies the high temperature set point. Once the exhaust temperature 90 hits the high temperature set point, the heater 42 may be turned OFF by the controller 14. Once the heater 42 is turned OFF, the exhaust temperature 90 will naturally drop until the exhaust temperature satisfies the low temperature set point. Then, the heater 42 is turned ON again by the controller 14, and it remains on until the exhaust temperature satisfies the high temperature set point again. The heater 42 then continues to cycle between the ON and OFF states until the termination of the drying cycle. The ON/OFF cycling of the heater 42 results in the exhaust temperature signal having a series of peaks and valleys.

As can be seen, a substantial portion of the moisture is removed prior to the outlet temperature reaching the high temperature set point 96 for the first time. During the cycle of the heater 42 between the ON/OFF states, the rate of moisture removal begins to slow and converges toward zero.

While the signal corresponding to the exhaust temperature of the exhaust air flow may be useful in monitoring the high temperature set point 96 and the low temperature set point 94, it is observed that the detailed characteristics of the exhaust temperature signal 90 may be used in determining when the laundry is deemed to be dry. It may be generally understood that every user may have a different preference in determining when the laundry 36 is dry. Generally, the laundry 36 may be determined to be dry when the moisture content in the laundry 36 is less than 2-4% by weight. However, most consumers do not prefer a completely dry load or what may be referred to a "bone dry". Thus, a standard for when a load is dry is when the laundry 36 has the moisture content of less than 5% by weight.

Figure 4:
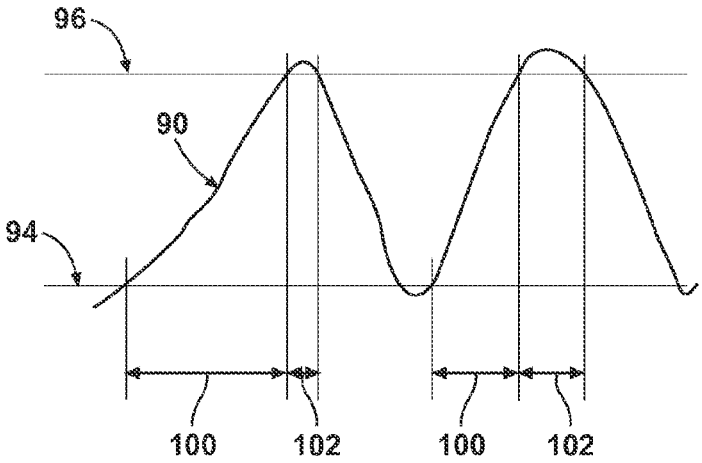
FIG. 4 is a portion of the exhaust temperature profile of FIG. 3, illustrating a trip time to heat time percentage (THP) algorithm defined according to a second embodiment of the invention.

FIG. 4 is a portion of the exhaust temperature profile of FIG. 3 showing two peaks with an intervening valley. Characteristics of the peaks have been found to be indicative of the degree of dryness of the laundry. For example, the ratio (THP) between the Heat Time 100 and the Trip Time 102 has been found to be indicative of the degree of dryness of the laundry 36. At least a portion of the exhaust temperature signal 90 may be filtered by at least one of the signal filter 88 and software applications before the Heat Time 100 and the Trip Time 102 are defined. The Heat Time 100 may be defined as the time it takes the exhaust temperature 90 to rise from the low temperature set point 94 to the high temperature set point 96. The Trip Time 102 may be defined as the time the exhaust temperature 90 is above the high temperature set point 96, which happens because the exhaust air temperature 90 continues to rise after the heater 42 is turned OFF for a variety of factors such as the upstream location of the heater 42 relative to the thermistor 51. The THP ratio may be represented in the following equation:

$$THP=[(\text{trip time})/(\text{heat time})]\times 100$$

It has been found that as a drying cycle progresses, the Trip Time 102 increases as the effect of evaporative cooling diminishes, and the Heat Time 100 for the temperature to rise to the high temperature set point 96 decreases for the same reason. Additionally, the loss of liquid such as water from the laundry 36 reduces the total heat capacity of the system, which results in faster warming rate and correspondingly shorter Heat Time 100. As a result, the THP value generally tends to increase with the time during a drying cycle. As the increasing number is in the numerator and the decreasing number in the denominator, the value of the THP ratio tends to increase relatively quickly to provide very good resolution related to the change in the degree of dryness.

A load may be determined to be dry when the THP value satisfies a predetermined reference value, such as a threshold, which can be an absolute value or a time rate of change, for example. It is contemplated that the reference value will be a function of the one or more of the machine, load size, load type, airflow, and consumer preference. For example, Delicate cycle may have a lower reference value than Heavy Duty cycle. The reference values can be experimentally determined and stored in the memory of the controller 14 for one or more of the drying cycles. Alternatively, the reference value can be calculated during the cycle of operation based on the first THP value within the current drying cycle, which reduces the variation due to the machine, load size, load type, and venting conditions. It is further contemplated that a single predetermined reference value may be used for all cycles of operation, but this would reduce the drying accuracy as compared to a different reference value for each cycle of operation or the dynamic calculation based on the first THP. It may be noted that the THP signal may be filtered before being compared to the reference value.

Once the THP satisfies the reference value, a drying cycle of the laundry 36 in the treating chamber 34 may be terminated. The termination of the drying cycle may be performed in multiple ways. For example, the supply air flow 58 may be provided with reduced heat by controlling the cycling of the heater 42. Alternatively, the heating to the supply air flow may be terminated so that the supply air flow 58 may not be heated by the heater 42 anymore. In another example, the laundry 36 in the treating chamber 34 may not tumble. In yet another example, the operation of the clothes dryer 10 may be turned OFF.

Figure 5:
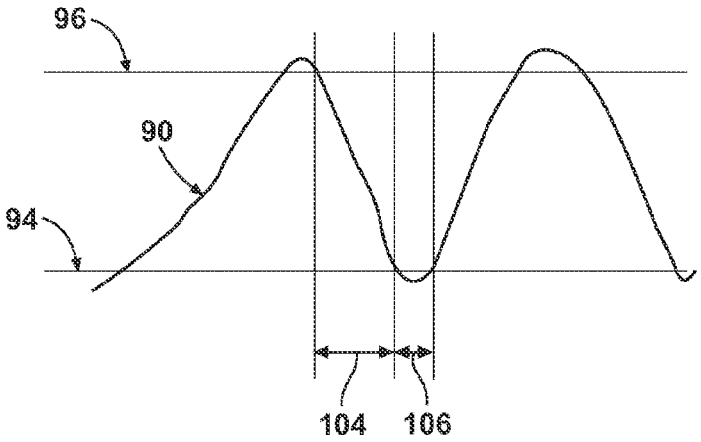
FIG. 5 is a portion of the exhaust temperature profile of FIG. 3, illustrating a cool time to reset time percentage (CRP) algorithm defined according to a third embodiment of the invention.

FIG. 5 illustrates another set of characteristics of the exhaust temperature signal 90 that may be used to determine when a load is dry. In FIG. 5, a cool time to reset time percentage (CRP) defined from a Cool Time 104 and a Reset Time 106, according to a third embodiment of the invention, may be used to determine when a load is dry. At least a portion of the exhaust temperature signal 90 may be filtered by at least one of the signal filter 88 and software applications before the Cool Time 104 and the Reset Time 106 are defined. The Cool Time 104 may be defined as the time it takes the exhaust temperature 90 to cool from the high temperature set point 96 to the low temperature set point 94. The Reset Time 106 may be defined as the time the exhaust temperature 90 stays below the low temperature set point 94. The CRP ratio may be represented by the following equation:

$$CRP=[(\text{cool time})/(\text{reset time})]\times 100$$

As a drying cycle progresses, the cool time tends to increase while the Reset Time 106 tends to decrease due to the diminished effect of evaporative cooling. As a result, the CRP generally tends to increase with the progress in a drying cycle.

The CRP ratio may be compared to a reference value in the same way as described for the THP ratio to determine when a load is dry. Similarly, the values for the CRP reference ratio may be determined in the same way as the values for the THP reference ratio.

Figure 6:
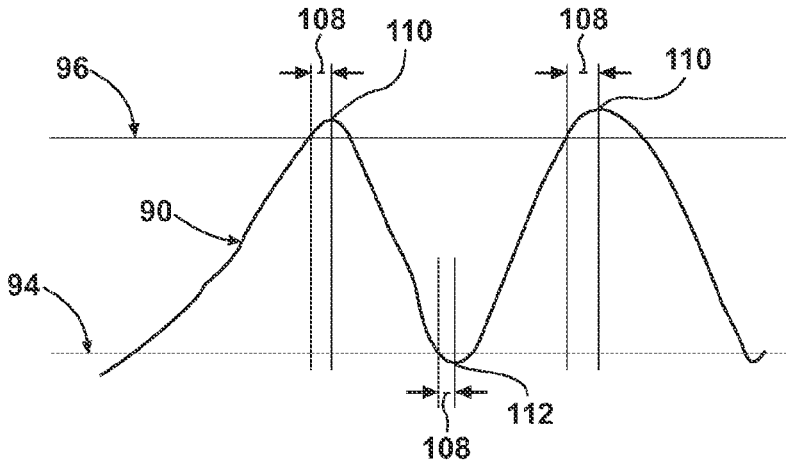
FIG. 6 is a portion of the exhaust temperature profile of FIG. 3, illustrating an extremum time algorithm defined according to a fourth embodiment of the invention.

FIG. 6 illustrates another set of characteristics of the exhaust temperature signal 90. As illustrated, an Extremum Time 108 may be used to determine when a load is dry, according to a fourth embodiment of the invention. At least a portion of the exhaust temperature signal 90 may be filtered by at least one of the signal filter 88 and software applications before the Extremum Time is defined. It may be understood the Extremum Time 108 may be defined in two ways; the time it takes the exhaust temperature 90 to rise from the high temperature set point 96 to a local maximum temperature 110 or the time it takes the exhaust temperature 90 to fall from the low temperature set point 94 to a local minimum 112.

As a drying cycle progresses, the time it takes the exhaust temperature 90 to rise from the high temperature set point 96 to a local maximum temperature 110 tends to increase while the time it takes the exhaust temperature 90 to fall from the low temperature set point 94 to a local minimum 112 tends to decrease.

The Extremum Time may be compared to a reference value, such as a threshold, to determine when a load is dry. For example, the reference value may be an absolute time period. It is contemplated that the reference value for the Extremum Time 108 may be determined based on at least one of the size and type of the laundry in the treating chamber 34 and the airflow through the clothes dryer 10.

It may be understood that there are two ways for the Extremum Time 108 to satisfy the reference value. While the Extremum Time 108 may satisfy the time the exhaust temperature 90 to rise from the high temperature set point 96 to the local maximum 110, the Extremum Time 108 may satisfy the time the exhaust temperature 90 to fall from the low temperature set point 94 to the local minimum 112.

Figure 7:
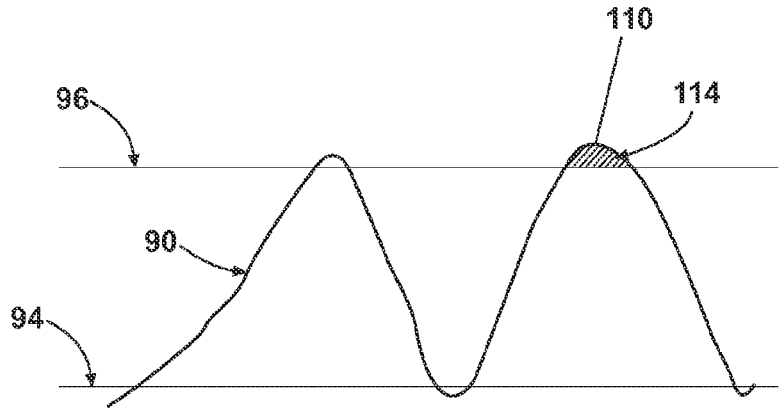
FIG. 7 is a portion of the exhaust temperature profile of FIG. 3, illustrating an overshoot area algorithm defined according to a fifth embodiment of the invention.

FIG. 7 illustrates yet another set of characteristics of the exhaust temperature signal 90. As illustrated, an overshoot area 114 may be used to determine when a laundry is dry, according to a fifth embodiment of the invention. The overshoot area 114 may be represented as a shaded area under the exhaust temperature profile 90 and above the high temperature set point 96. At least a portion of the exhaust temperature signal 90 may be filtered by at least one of the signal filter 88 and software applications before the overshoot area 114 is defined.

Generally a local maximum temperature 110 in each peak of the exhaust temperature signal 90 tends to increase as a drying cycle progresses. The time period during which the exhaust temperature signal 90 remains above the high temperature set point 96 also tends to increase. As a result, the overshoot area 114 generally tends to increase as a drying cycle progresses.

The overshoot area 114 may be compared to a reference value in the same way as described for the Extremum Time 108 to determine when a load is dry. The reference value, such as a threshold, may be an area, for example, and may be determined by one or more software applications executed by the CPU 74. The reference value may be determined based on at least one of the size and type of the laundry 36 in the treating chamber 34 and the airflow through the clothes dryer 10. Once the overshoot area 114 satisfies the threshold, the drying cycle of the laundry 36 in the treating chamber 34 may be terminated, as described for the THP.

The invention described herein uses algorithms to properly determine the completion of a drying cycle in the clothes dryer 10. Instead of using the moisture sensor which may be susceptible to inaccuracies during measurement, the algorithms may be simply constructed based on the exhaust temperature profile that is measured by the thermistor 51. Due to the robustness of the thermistor, the completion of the drying cycle for the laundry load may be consistently determined without incurring extra cost for equipment or components.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method of drying laundry by operating a laundry dryer having a treating chamber for receiving laundry for drying, the method comprising:

supplying air to the treating chamber to define a supply air flow;

exhausting the supply air flow from the treating chamber to define an exhaust air flow;

repeatedly determining over time a temperature of the exhaust air flow to define an exhaust temperature signal;

heating the supply air flow by repeatedly cycling a heater for the supply air flow between an ON state, which starts when the exhaust temperature signal satisfies a low temperature set point, and an OFF state, which starts when the exhaust temperature signal satisfies a high temperature set point;

determining from the exhaust temperature signal a cool time corresponding to a time it takes the exhaust temperature to fall from the high temperature set point to the low temperature set point, and a reset time corresponding to a time the exhaust temperature is below the low temperature set point;

determining a ratio between the cool time and the reset time; and initiating a termination of the drying of the laundry when the ratio indicates the laundry is dried.

2. The method of claim 1 wherein determining the ratio comprises determining the ratio of the cool time to the reset time.

3. The method of claim 1 further comprising comparing the ratio to a reference ratio indicative of the laundry being dried.

4. The method of claim 3 wherein the reference ratio is a threshold ratio and the ratio indicates the laundry is dried when the ratio satisfies the threshold ratio.

5. The method of claim 3 wherein the reference ratio is selected based on at least one of size and type of the laundry in the treating chamber and the airflow through the dryer.

6. The method of claim 3 wherein the laundry is dried when the laundry has less than 5% by weight residual moisture content.

7. The method of claim 6 wherein the laundry is dried when the laundry has between 2-4% by weight residual moisture content.

8. The method of claim 1 wherein initiating the termination of the drying comprises at least one of: reducing the heating of the supply air flow, terminating the heating of the supply air flow, and terminating a tumbling of the laundry.

* * * * *